US008634748B2

(12) United States Patent
Amemiya

(10) Patent No.: US 8,634,748 B2
(45) Date of Patent: Jan. 21, 2014

(54) IMAGE FORMING APPARATUS HAVING AN APPARATUS BODY WITH OPENABLE AND FIXED COVERS

(75) Inventor: Kanae Amemiya, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 350 days.

(21) Appl. No.: 13/064,936

(22) Filed: Apr. 27, 2011

(65) Prior Publication Data

US 2011/0303687 A1 Dec. 15, 2011

(30) Foreign Application Priority Data

Jun. 11, 2010 (JP) ..... 2010-133698
Apr. 8, 2011 (JP) ..... 2011-086838

(51) Int. Cl.
*G03G 15/01* (2006.01)
*G03G 15/08* (2006.01)

(52) U.S. Cl.
USPC ..... 399/224; 399/262

(58) Field of Classification Search
USPC ..... 399/112, 223, 224, 258, 262, 263; 222/DIG. 1
See application file for complete search history.

(56) References Cited

U.S. PATENT DOCUMENTS 5,648,840 A * 7/1997 Ikunami et al. ..... 399/262
6,304,739 B1 10/2001 Katsuyama et al.
6,507,720 B2 1/2003 Kabumoto et al.
7,275,808 B2 10/2007 Katsuyama et al.
7,327,975 B2 * 2/2008 Tanaka ..... 399/262
7,469,981 B2 12/2008 Katsuyama et al.
7,657,206 B2 * 2/2010 Sato ..... 399/119
7,801,469 B2 * 9/2010 Uezono ..... 399/263
8,050,597 B2 * 11/2011 Yoshizawa et al. ..... 399/262
2002/0009310 A1 1/2002 Kabumoto et al.
2005/0270345 A1 12/2005 Katsuyama et al.
2006/0023005 A1 2/2006 Katsuyama et al.
2009/0074494 A1 3/2009 Katsuyama et al.
2010/0177361 A1 7/2010 Amemiya
2010/0226690 A1 9/2010 Kadota et al.
2011/0058857 A1 3/2011 Hori et al.

FOREIGN PATENT DOCUMENTS

EP 820873 A2 * 1/1998
JP 2003076123 A 3/2003
JP 2003316139 A 11/2003
JP 2006113482 A 4/2006
JP 2006251346 A 9/2006
JP 2009008698 A 1/2009

* cited by examiner

*Primary Examiner* — Robert Beatty
(74) *Attorney, Agent, or Firm* — Harness, Dickey & Pierce, P.L.C.

(57) ABSTRACT

An image forming apparatus includes an apparatus body, a top cover a top surface of the apparatus body, a container-installation section in which a replaceable container is removably installable, a first holder, and a second holder. The container includes a container body to contain consumables, having a transparent portion that makes the color of the consumables contained in the container body is viewed from outside thereof, and a connecting portion connectable to the container-installation section, to supply the consumables from the container to the apparatus body. The first holder holds the connecting portion and cover the connecting portion so that the connecting portion is not visible when the top cover is opened; and the second holder holds the container body, such that the color of the consumables in the container body are visible through the transparent portion of the container body when the top cover is opened.

20 Claims, 12 Drawing Sheets

IMAGE FORMING APPARATUS HAVING AN APPARATUS BODY WITH OPENABLE AND FIXED COVERS

CROSS-REFERENCE TO RELATED APPLICATIONS

This patent specification claims priority from Japanese Patent Applications Nos. 2010-133698, filed on Jun. 11, 2010 and 2011-086838, filed on Apr. 8, 2011 in the Japan Patent Office, the entire contents of which are hereby incorporated by reference herein.

BACKGROUND OF THE INVENTION

1. Field of the Invention

The present invention relates to an image forming apparatus such as a copier, a printer, a facsimile machine, a plotter, and a multi-function machine, including a replaceable container containing consumables.

2. Description of the Background

Electrophotographic image forming apparatuses such as copiers, printers, facsimile machines, plotters, multi-function machines, or the like typically include replaceable containers (e.g., toner bottles, ink cartridges, ink containing bags) that contain consumables (powder, liquid, or gel), such as toner or ink. In general, toner containers (bottles) that are removably installable in the image forming apparatuses are used.

In order to set the container (e.g., toner bottle) into the image forming apparatus body, better visibility of the container in the image forming apparatus is a requirement. Conversely, in order to protect the user from injury by a connecting portion of the container for installing or connecting the container in or to the image forming apparatus and prevent the vicinity of the connecting portion from contamination by the spilled toner and ink, the connecting portion is usually hidden.

For example, in a related art image forming apparatus 1 shown in FIG. 1, the image forming apparatus 1 includes an image forming unit 1*a* and a front cover 1*b*. When the front cover 1*a* is opened, four installation openings 2 in a front face of the image forming unit 1*a* are visible, and four toner bottles 3Y, 3M, 3C, and 3K respectively containing yellow, magenta, cyan, and black toners are installed in the corresponding installation openings 2. In a state in which the toner bottles 3 are inserted into the installation openings 2, the image forming unit 1*a* forms an image and prints the image onto a recording medium.

The toner bottles 3 includes a bottle body 32 that contains toner and a connecting portion (cap) 31 that is inserted into the image forming unit 1*a* (apparatus body) of the image forming apparatus 1. In other types of containers, the container is formed of a connecting portion to be inserted into the apparatus body of the image forming apparatus and a container body other than the connecting portion, similarly to the toner container.

FIGS. 2A and 2B are expanded views illustrating the toner bottle 3 and the vicinity of the installation openings 2. In FIG. 1, because the apparatus body 1*a* can hide not only the connecting portion 31 of the toner bottle 3 but also the bottle body 32 of the toner bottle 3, the user is less likely to be able to discriminate between the respective colors (Yellow (Y), Magenta (M), Cyan (C), and Black (K)) contained in the bottle body 32 of the toner bottle 3. More specifically, the user can see only a posterior end of the bottle body 32 that is an end opposite the end at which the connecting portion 31 is located in a state in which the toner bottles 3 are inserted into the installation openings 2. Thus, since the bottle body 32 of the toner bottle 3 is formed of a transparent (or semi-transparent) resin, the user can only confirm the color of the toner contained in the toner bottle 3 by pulling out the toner bottle 3 from the installation opening 2 in the apparatus body 1*a* either entirely as shown in FIG. 2A) or partially as shown in FIG. 2B.

Moreover, recently, image forming apparatuses, such as a printer that is connectable to a personal computer, have been personalized, thus making the printer more compact. However, due to limitations imposed by body size of the printer, the configuration shown in FIG. 1 may be difficult to adapt to a compact printer. In a compact printer 10 like that shown in FIG. 3, a portion where the toner bottles 3 are disposed is completely covered with an external cover 12 surrounding a top surface of an entire printer body 11 of the printer 10.

In the printer 10, since the bottle body 32 of the toner bottle 3 is formed of a transparent and/or semi-transparent resin, the user can confirm the colors (Y, M, C, and K) of the toner contained in the toner bottle 3.

FIG. 4 shows an expanded diagram of the vicinity of the toner bottles 3 in the printer 10 shown in FIG. 3. As described above, in this example, since a portion where the toner bottles 3 are disposed is entirely covered by the external cover 12 surrounding a top surface of an entire printer body 11, not only the bottle bodies 32 of the toner bottles 3 but also the connecting portions 31 of the toner bottles 3 are exposed when the external cover 12 is opened. FIG. 4 also shows an installation holder 19 of the printer body 11, and in which reference character D represents spilled toner in the vicinity of the connecting portion 31 of the toner bottle 3 and close to the installation holder 19 of the printer body 11.

As can be seen from FIG. 4, since the connecting portion 31 of the toner bottle 3 is exposed when the exterior cover 12 is opened, when the user touches the toner bottle 3 in this condition, the toner D may be scattered inside or outside the apparatus. Further, the user's hands may become dirty by the toner D.

In an effort to counteract the above-described problem, some image forming apparatuses provide an internal cover as well as an external cover, so that the portion where the toner bottles are disposed is covered doubly with the interior cover and the exterior cover. However, such a configuration is complicated and costly.

SUMMARY OF INVENTION

In an aspect of this disclosure, there is provided an image forming apparatus that includes an apparatus body, a top cover, a container-installation section, a first holder, and a second holder. The apparatus body includes an image forming unit to form an image on a recording medium. The top cover covers a top surface of the apparatus body. The container-installation section is a portion in which at least one replaceable container is removably installable, positioned in the apparatus body. The container includes a container body to contain consumables, having a transparent portion that makes the color of the consumables contained in the container body is viewed from outside thereof, and a connecting portion connectable to the container-installation section of the apparatus body, to supply the consumables from the container to the apparatus body. The first holder, provided in the container-installation section of apparatus body, holds the connecting portion of the container in a state in which the container is installed in the apparatus body and cover the connecting portion so that the connecting portion is not visible when the top cover is opened. The second holder, provided in the container-installation section of the apparatus body, holds the container body of the container in the state in which the container is installed in the apparatus body, such that the color of the consumables in the container body are visible through the transparent portion of the container body when the top cover is opened.

In additional aspect, there is provided an image forming apparatus that includes an apparatus body, container-installation section, a top cover, and a fixed cover. The apparatus body includes an image forming unit to form image onto a recording medium. The container-installation section is a portion in which at least one replaceable container removably installable in the apparatus body, positioned in the apparatus body. The container includes a container body to contain consumables such that the color of consumables contained in the container body is viewed from outside thereof, and a connecting portion to be installed in the apparatus body. The top cover covers a portion in which the container body of the container is disposed in the apparatus body, dimensioned so that substantially the entire container body of the container is exposed and the color of the consumables in the container body are visible when the top cover is opened. The fixed cover covers a vicinity of the connecting portion of the container so that the connecting portion of the container is not visible from the outside when the top cover is opened.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
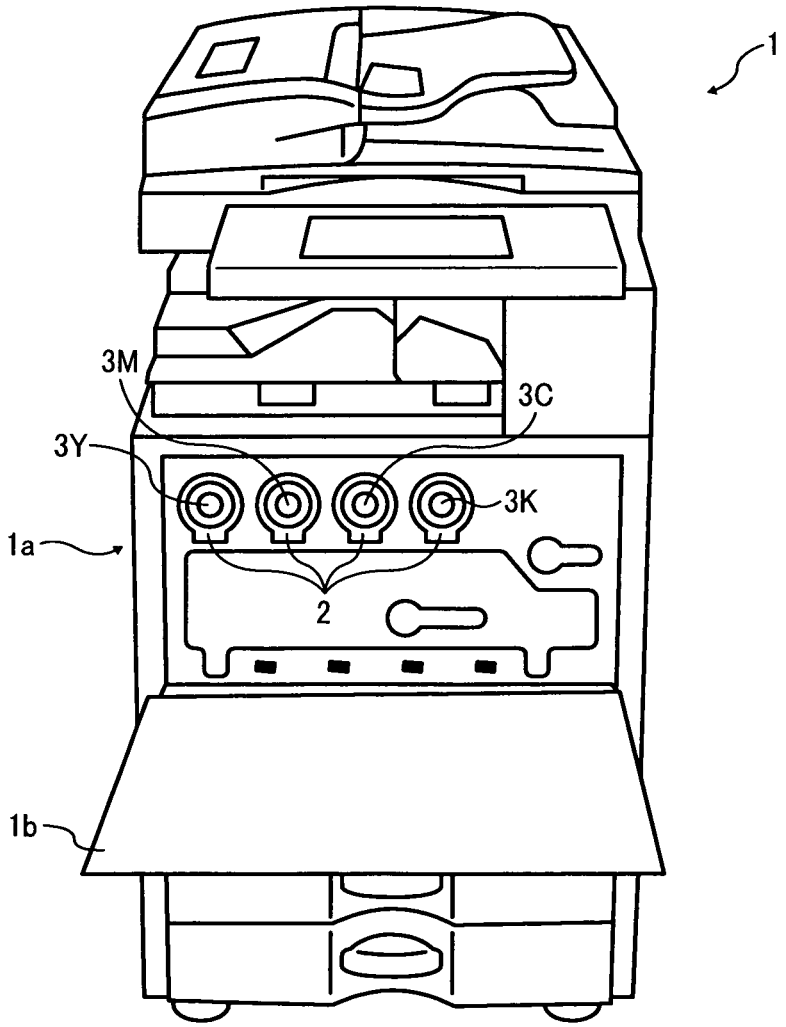
FIG. 1 RELATED ART
FIG. 1 is a front view illustrating an image forming apparatus according to a related art example.
Figure 2A:
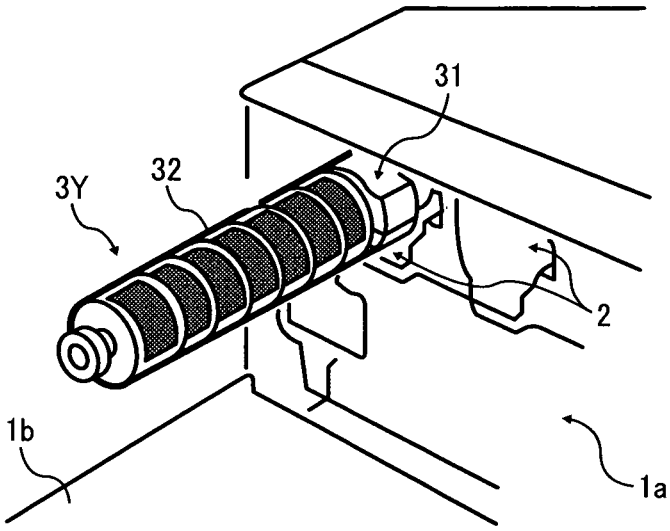
FIG. 2A RELATED ART
FIGS. 2A and 2B are perspective views illustrating a toner bottle and a vicinity of an installation opening in the image forming apparatus shown in FIG. 1.
Figure 2B:
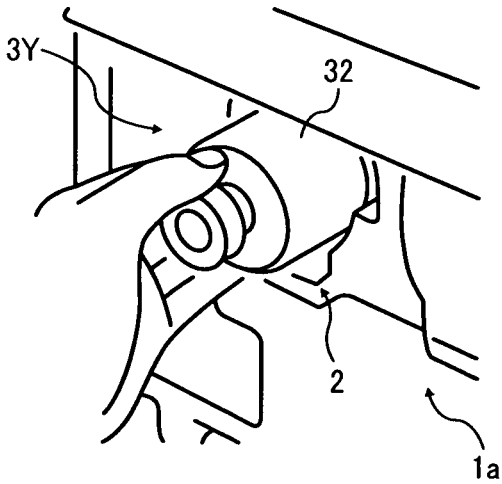
FIG. 2B RELATED ART
Figure 3:
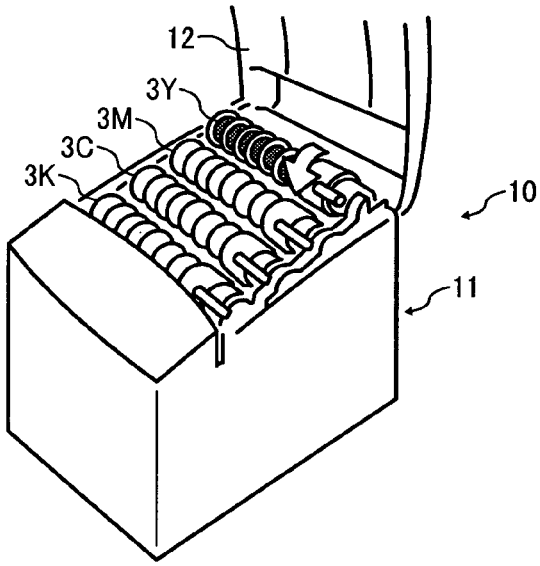
FIG. 3 RELATED ART
FIG. 3 is a perspective view illustrating a compact printer according to another related art example.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 5, an image forming apparatus that is a multicolor image forming apparatus (hereinafter referred to as an image forming apparatus) according to an illustrative embodiment of the present invention is described.

The image forming apparatus according to the present embodiment is a multifunction machine that functions as an image forming apparatus that prints images on sheets of recording media in accordance with instruction from host devices such as computers, a scanner that scans original documents, a facsimile, and a copier.

In the following embodiments, hereinafter the term "image forming apparatus" includes printers but is by no means limited thereto. In addition, the term "toner bottle" means not just only a narrowly-defined toner bottle, but means a container in a broad sense, which containing consumables, such as toner, ink, a developer, used for various types of image forming apparatus, such as, gel-jet image forming apparatus, ink-jet image forming apparatus.

In this embodiment, cylindrical toner bottles are used as containers. However, the container is not only limited to a cylindrical shape. Thus, for example, the container may be polygonal or square pole.

Further, as used in this specification, the term "transparent" specifically includes not only that which is transparent but also anything that is semi-transparent.

Figure 5:
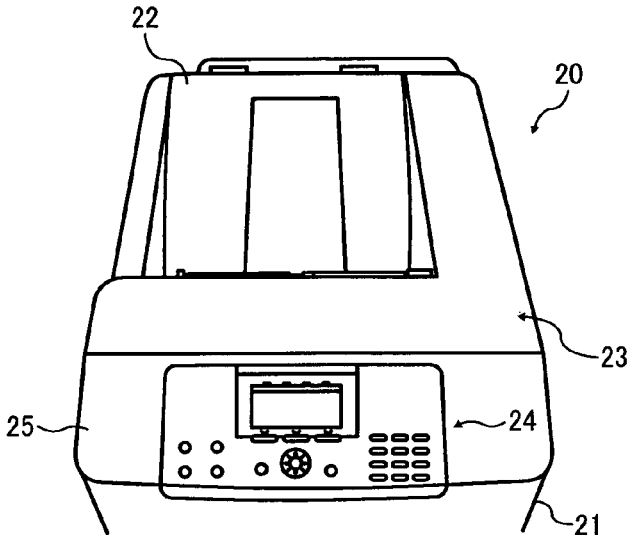
FIG. 5 is a front perspective view illustrating a color image forming apparatus installing toner containers according to a first illustrative embodiment.
Figure 6:
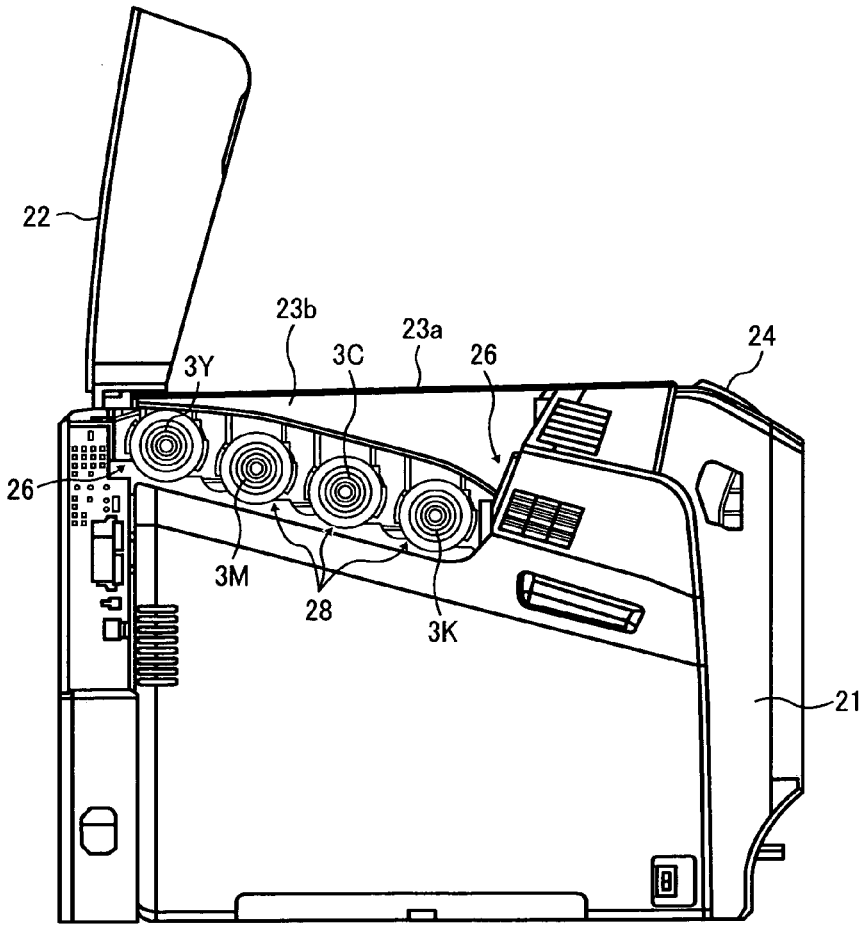
FIG. 6 is a lateral cross-sectional view illustrating the image forming apparatus shown in FIG. 5.
Figure 7:
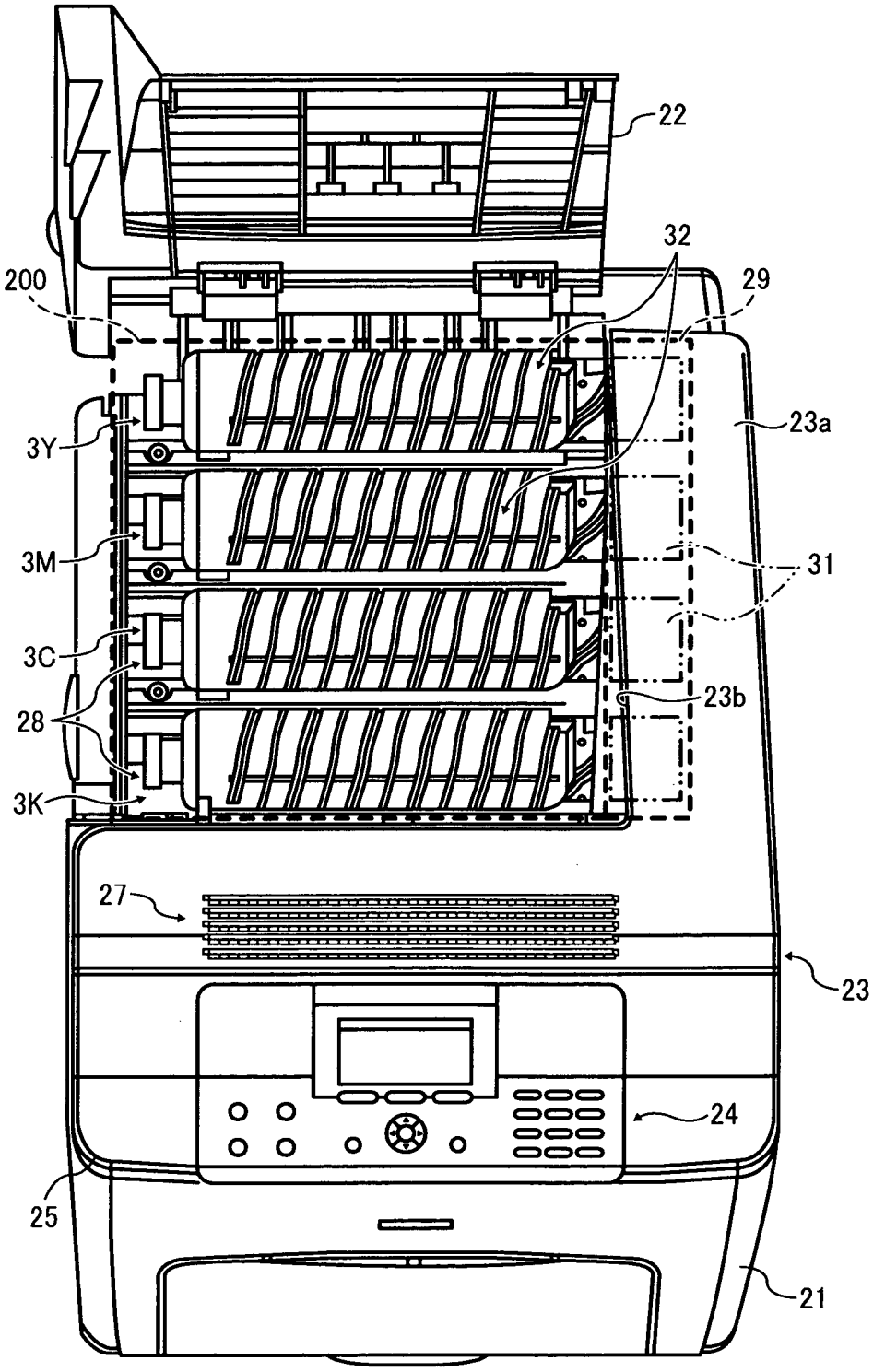
FIG. 7 is a front perspective view illustrating the image forming apparatus shown in FIG. 5 when a top cover is opened.
Figure 8:
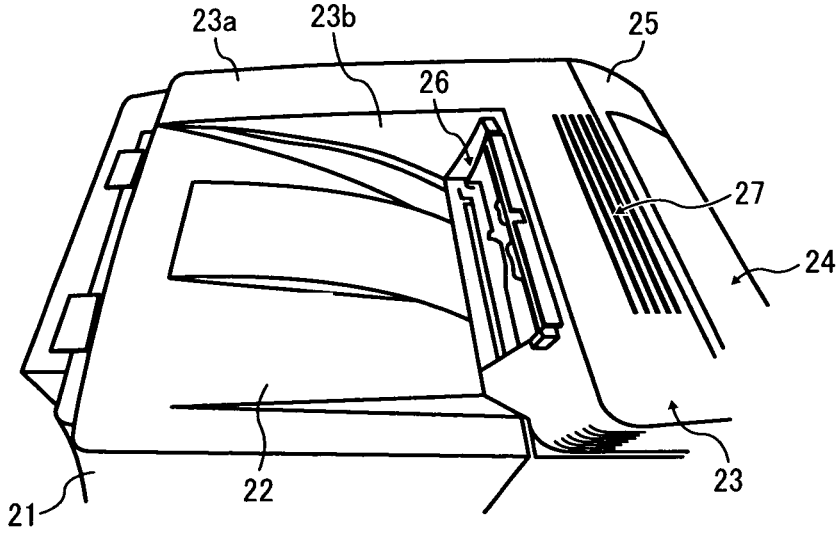
FIG. 8 is a left-side perspective view illustrating the image forming apparatus shown in FIG. 5 when the top cover is closed.
Figure 9:
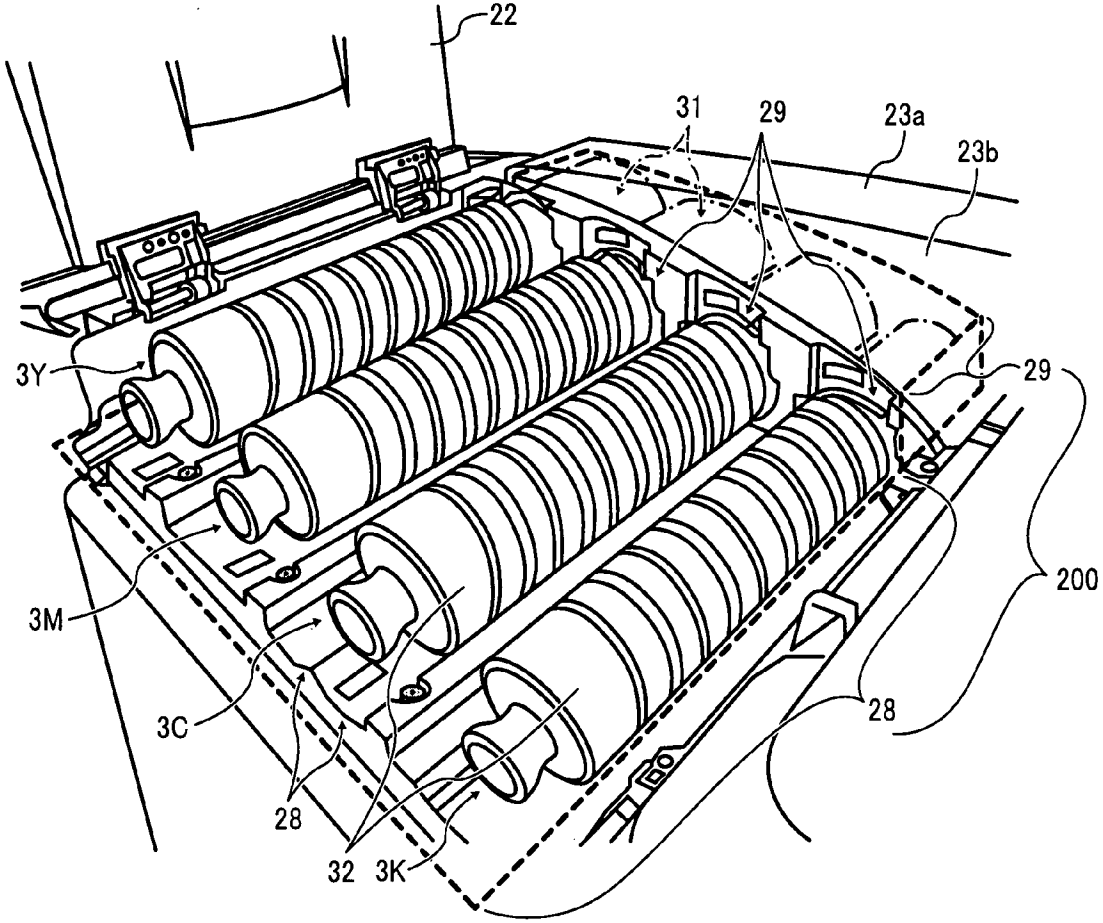
FIG. 9 is an expanded left-side perspective view illustrating the image forming apparatus shown in FIG. 5 when the top cover is opened.

FIG. 5 is a front perspective view illustrating a color image forming apparatus 20 according to the present embodiment. FIG. 6 is a lateral cross-sectional view illustrating the image forming apparatus 20. FIG. 7 is a front perspective view illustrating the image forming apparatus 20 when a top cover 22 is opened. FIG. 8 is a left-side perspective view illustrating the image forming apparatus 20 when the top cover 22 is closed. FIG. 9 is an expanded left-side perspective view illustrating the image forming apparatus 20 when the top cover 22 is opened.

In FIGS. 5 through 7, the image forming apparatus 20 includes an apparatus body 21 (image forming unit) that forms an image and prints the image onto a recording medium. A top surface of the apparatus body 21 is covered with the top cover 22, a lateral fixed cover 23*a* in a fixed cover 23, an operating portion 24, and the operation portion cover 25. In addition, a bottle-installation section 200, serving as a container-insulation section, is provided in an upper part of the apparatus body 21 in the image forming apparatus 20, and four toner bottles 3Y, 3M, 3C, and 3K respectively corresponding to yellow, magenta, cyan, and black are detachably installable in (connectable to) the bottle-installation section 200 of the apparatus body 21. The bottle holding section 200 where the toner bottles 3Y, 3M, 3C, and 3K are disposed is covered with two upper exterior covers. More specifically, the bottle-installation section 200 is covered with the top cover 22 that swings vertically and the lateral fixed cover 23*a* of the fixed cover 23 positioned right side of the apparatus body 21 viewed from front side shown in FIG. 5.

Next, with reference to FIGS. 10 through 13, the configuration of the toner bottle 3 is described below.

Figure 10:
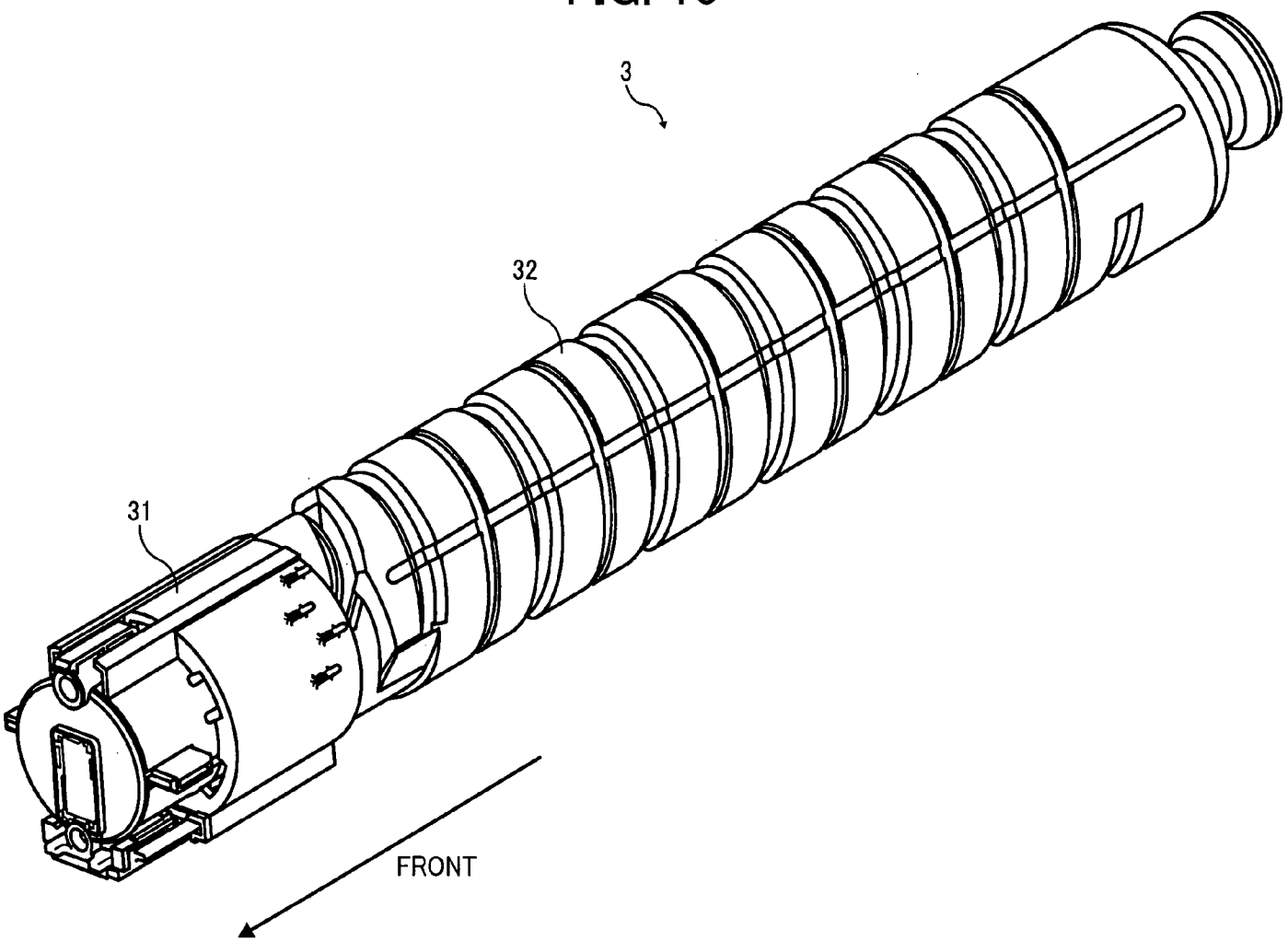
FIG. 10 is perspective view illustrating the toner bottle as an expandable container viewed from above.

FIG. 10 is a perspective view illustrating the toner bottle 3 viewed from above. In FIG. 10, the toner bottle 3 includes a bottle body 32 and a connecting portion (cap) 31.

Figure 11:
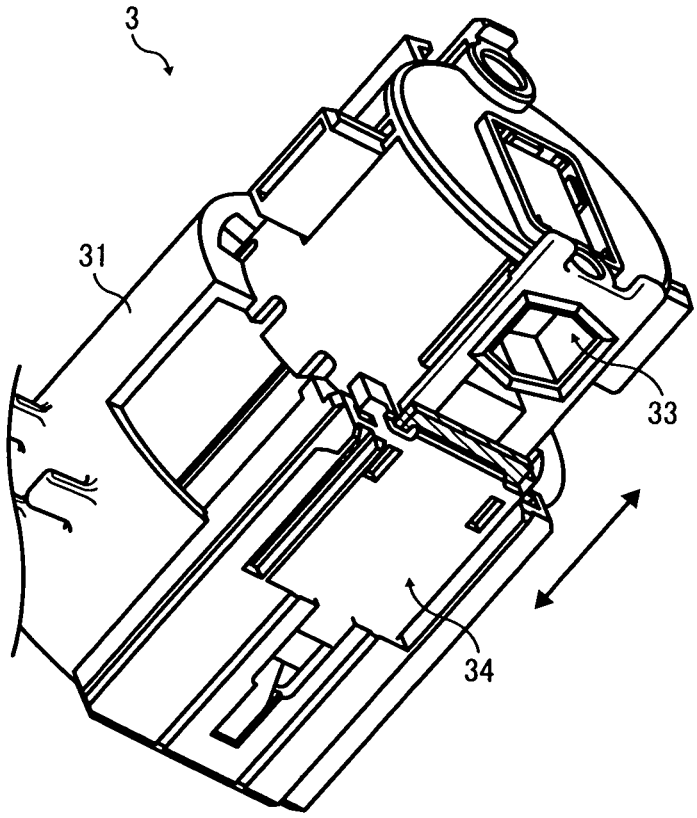
FIG. 11 is a perspective view illustrating the connecting portion of the toner bottle of FIG. 10 viewed from beneath.

FIG. 11 is a perspective view illustrating the connecting portion 31 of the toner bottle 3 viewed from beneath. With reference to FIG. 11, a toner supply opening (toner outlet) 33 is formed on a lower side of the connecting portion 31. A shutter 34 is attached to a lower face of the connecting portion 31 to open and close the toner supply opening 33. When the toner bottle 3 is installed in the bottle-installation section 200 of the apparatus body 21 in the image forming apparatus 20, the shutter 34 in the toner bottle 3 is moved in synchronization with the installation of the toner bottle 3, and the toner supply opening 33 of the toner bottle 3 is opened.

Figure 12:
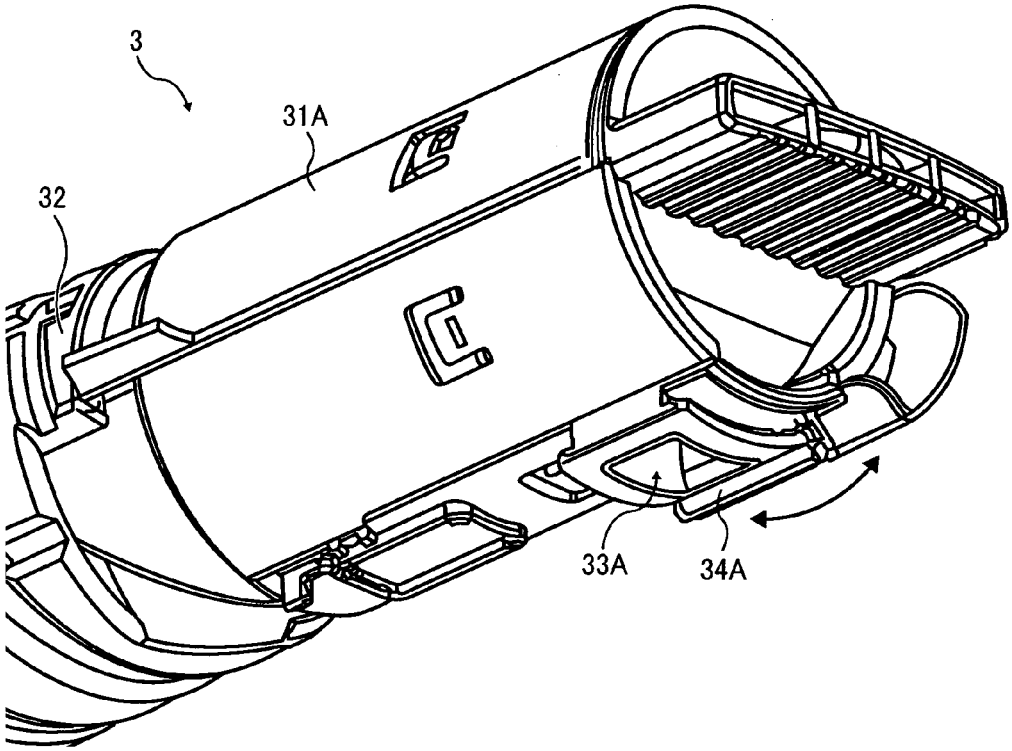
FIG. 12 is a perspective view illustrating a connecting portion that is a variation of the connecting portion of the toner bottle FIG. 10 viewed from beneath.

FIG. 12 is a perspective view illustrating a connecting portion 31A that is a variation of the connecting portion 31 viewed from beneath. With reference to FIG. 12, a toner supply opening (toner outlet) 33A is formed on a circumferential face of the connecting portion 31A. A shutter 34A is attached to a circumferential face of the connecting portion 31A to open and close the toner supply opening 33A. The shutter 34A moves in a circular direction of the toner bottle 3.

Referring back to FIGS. 7 and 9, in the image forming apparatus 20, because the bottle body 32 has a portion formed of a transparent resin, that is, transparent bottle is used for the bottle body 32, the color of the toner in the bottle body 32 is visible, and therefore, the visibility problem that the color of the toner contained in the bottle body 32 is less likely to be seen from outside can be solved.

In addition, the toner bottle 3 is not entirely covered with a single exterior cover of the apparatus body 21 but covered with the separate top cover 22 and the fixed cover 23*a*.

With this configuration, only the bottle body 32 of the toner bottle 3 is exposed when the top cover 22 is opened. By contrast, the connecting portion 31 of the toner bottle 3 is not exposed (is hidden by the fixed cover 23) when the top cover 22 is opened.

Herein, a distal side of a top surface of the apparatus body 21 is formed by the top cover 22, functioning as a discharge tray onto which the recording medium after image formation is discharged outside the apparatus body 21, and the lateral fixed cover 23*a* disposed on the other portion of the top cover 22. A proximal side of the top surface of the apparatus body 21 is formed by the operation portion 24 and the operation portion cover 25. The toner bottle 3 is disposed beneath the distal side of the top surface, that is, the bottle body 32 and the connecting portion 31 are separately covered with the top cover 12 and the lateral fixed cover 23*a* (a lateral surface) of the fixed cover 23.

As shown in FIG. 6, the top cover 22 that is supported by a rotary shaft 21*s* provided in the distal side of the apparatus body 21 swings vertically to open and close the bottle-installation section 200 in which the toner bottles 3 are disposed in the apparatus body 21. In FIG. 8, reference numeral 26 represents a discharge opening through which the recording medium after the image formation is discharged, and 27 represents a vent-slit through which air in the apparatus body 21 is discharged outside. A longitudinal direction of the rotary shaft 21*s* parallels a longitudinal direction (axis direction) of the toner bottle 3.

With reference to FIGS. 6 and 9, in the image forming apparatus 20, the bottle-installation section 200 of the apparatus body 21 that detachably holds the toner bottles 3Y, 3M, 3C, and 3K includes four installation holders 29 (installation openings) that hold the connecting portions 31 of the toner bottles 3 and bottle holders 28 that hold the bottle bodies 32 of the toner bottles 3. The installation holder serves as a first holder. The bottle holders, serving as second holders, are constituted by four concaves 28 formed on an installation face (second top lateral face) of the apparatus body 21. In addition, four installation holders (openings) 29 in the apparatus body 21 are formed on a vertical face 23*b* under the lateral fixed face 23*a*. The lateral fixed face 23*a* is alighted with the right side surface of the apparatus body 21. The vertical face 23*b* functions as a border with respect to the top cover 22.

Alternatively, the fixed cover 23 can be designed to be openable. In this case, it is preferable that only the top cover 22 be opened and closed normally, and the fixed cover 23 designed not to be opened easily.

In a state in which the connecting portion 31 of the toner bottle 3 is inserted into the installation holder 29 of the apparatus body 21, the bottle body 32 (the color of the toner therein is visible) can be viewed, that is, the color of the toner therein is visible unless the top cover 22 is closed.

More specifically, in a state in which the top cover 22 is opened as shown in FIG. 9, the upper side of the bottle body 32 of the toner bottle 3 and a posterior end of the bottle body 32 in a direction in which the toner bottle 3 is installed in the apparatus body 21 are exposed. In other words, when the top cover 22 is opened, a space is created above the bottle body 32 of the toner bottle 3 and next to a posterior of the bottle body 32 in a direction in which the toner bottle 3 is installed in the apparatus body 21.

With this configuration, the bottle body 32 of the toner bottle 3 is easily visible, and thus, the color of the toner contained in the bottle body 32 can be seen from outside when the top cover 22 is opened. Since not only the upper side of the bottle body 32 but also the back end side of the bottle body 32 in the installation direction are exposed, the bottle 31 is visible.

By contrast, the connecting portion 31 of the toner bottle 3 hidden from outside when the top cover 22 is opened because the connecting portion 31 is inserted into the installation holder 29 of the apparatus body 21.

Figure 13:
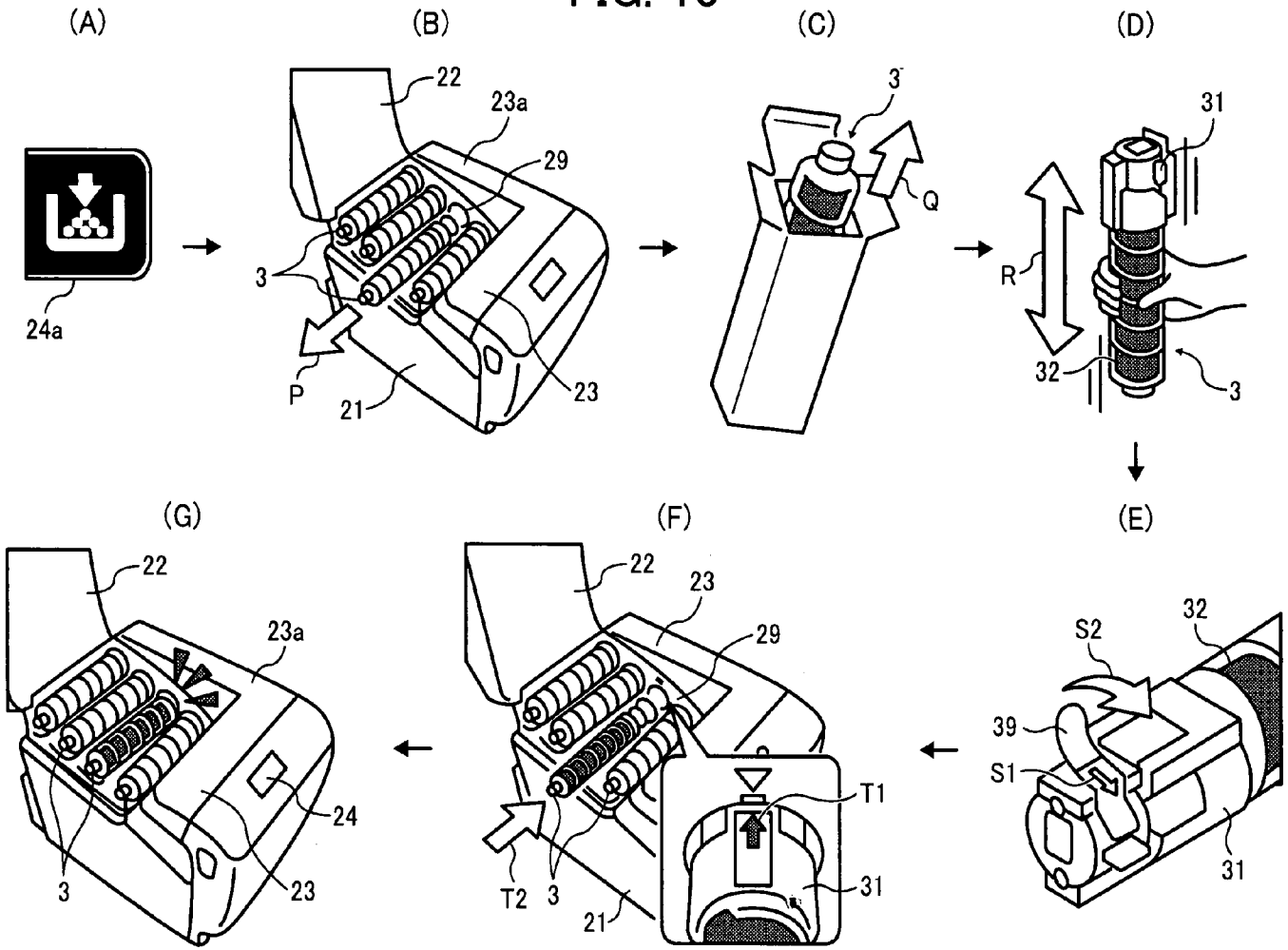
FIG. 13 shows replacement process of the toner bottle into the image forming apparatus shown in FIG. 5.

FIG. 13 shows a process of replacing the toner bottle 3.

Thus, for example, initially, in a state A shown in FIG. 13, a mark 24*a* that prompts the user (or operator, service-member) to replace the toner bottle 3 is displayed in the operation portion 24 of the image forming apparatus body 21. Then, the user pulls the toner bottle 3 (toner bottle 3C) from the image forming apparatus body 21 in a direction indicated by arrow P in a state B in FIG. 13, and the connecting portion 31 of the toner bottle 3C is pulled out from the installation holder 29 of the apparatus body 21 in the image forming apparatus 20.

While the user pulls the toner bottle 3 out from the image forming apparatus 20, although the toner may be spilled out to the vicinity of the installation holder 29 of the apparatus body 21, the installation holder 29 are always covered with (surrounded by) the fixed cover 23, the user during operating does not touch the leaked toner even when the toner is spilled.

Subsequently, in a state C shown in FIG. 13, a new toner bottle (e.g., toner bottle 3C for cyan color) is pulled out from a box in a direction indicated by arrow Q in a state C shown in FIG. 13. Then, because the toner contained in the toner bottle 3 may have low fluidity, the user needs to shake the toner bottle 3 at appropriate times (for example 7 or 8 times), in a direction indicated by arrow R in a state D shown in FIG. 13.

Furthermore, a storage seal 39 attached to the connecting portion 31 of the toner bottle 3 is pealed off in a direction indicated by arrow S2 according to a direction indicated by arrow S1 printed in the storage seal 39, in a state E shown in FIG. 13.

Then, the toner bottle 3 is put on the concave 28, functioning as the bottle holder, and the toner bottle 3 slides on the concave 28 to the installation holder 29 of the apparatus body 21, in a direction indicated by arrow T2 according to a direction indicated by arrow T1 printed on the connecting portion 31 of the toner bottle 3 in a state F shown in FIG. 13. Then, the connecting portion 31 of the toner bottle 3 is inserted into the installation holder 29 of the apparatus body 21, that is, the toner bottle 3 is set in image forming apparatus 20 (see a state G shown in FIG. 13).

Herein, because the arrow indicating an insertion direction of the connecting portion 31 into the installation holder 29 represents in the connecting portion 31 of the toner bottle 3 (see arrow T2 in the state F shown in FIG. 13), the user can easily insert the connecting portion 31 of the toner bottle 3 into the installation holder 29 of the image forming apparatus body 21 when user does not know specifically replacement process of the image forming apparatus 20.

Figure 4:
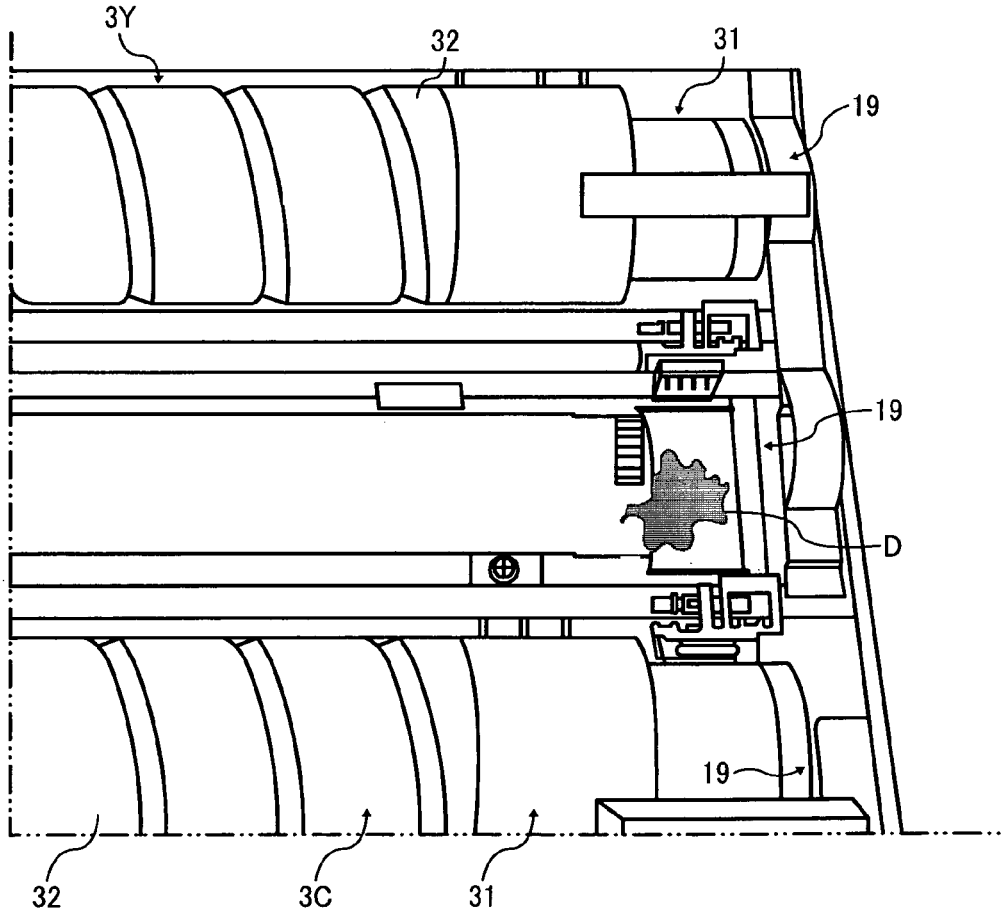
FIG. 4 RELATED ART
FIG. 4 is an expanded perspective view illustrating the vicinity of the installation holder in the printer shown in FIG. 3.

As a variation of installation process, in order to set the connecting portion 31 of the toner bottle 3A into the installation holder 29 of the image forming apparatus body 21, the toner bottle 3A is rotated (for example, quarter rotation) after the connecting portion 31 is inserted into the installation holder 29 of the image forming apparatus body 21. In this configuration, the toner bottle 3A (see FIG. 12) is installed in the apparatus body 21 in the image forming apparatus 20 (like that the configuration of the vicinity of the installation holder shown in FIG. 4).

In the configurations toner bottles 3(3A), when the connecting portion 31 of the toner bottle 3 is inserted into the insertion holder 29 of the image forming apparatus body 21, that is, the connecting portion 31 is inserted beneath the lateral fixed cover 23*a*, the connecting portion 31 is covered with the lateral fixed cover 23*a*.

As described above, in the image forming apparatus 20, the top cover 22 that opens and closes the top surface of the image forming apparatus body 21 for replacement of the toner bottle 3 does not open an entire top surface of the image forming apparatus body 21, and the lateral fixed cover 23*a* is normally remains closed state when the top cover 22 is opened. Therefore, the connecting portion 31 of the toner bottle 3 is not seen from the bottle body 32 side (from lateral side) and from image apparatus body 21 side (from above) when the top cover 22 is opened.

With this configuration, the user can reliably acquire optimum visibility of the bottle body 32 of the toner bottle 3 from outside and can replace the toner bottle 3 safely. For example, a handicapped user sitting in a wheelchair can replace the toner bottle 3 not while the toner bottle 3 and the installation holder 29 viewing from above but while viewing them from a side face (left side face shown in FIG. 5) by coming around the left side of the image forming apparatus 20. At this time, one side (left side shown in FIG. 5) of the top surface of the apparatus body 21 is opened (the fixed cover is not present) the operability and the visibility of replacement of the toner bottle 3 can be secured while the user sits in the wheelchairs.

It is to be noted that, although the top cover 22 (exterior cover) is provided on the top surface (upper portion) of the apparatus body 21 in the image forming apparatus 20, the setting position of the top cover is not limited to the upper portion of the apparatus body 21. Thus, for example, the top cover can be set on a side surface of the image forming apparatus body, and the cover positioned obliquely with respect to the top surface and the side surface, can be adapted. The below embodiment is similar.

Second Embodiment

It is to be noted that although a quadruplet tandem-type direct transfer multicolor (full-color) image forming apparatus is described above as the image forming apparatus according to the various embodiments of the present specification, an image forming apparatus according to in the present specification is not limited to the above-described quadruplet tandem-type, is also applicable to a monochrome type (single-color) image forming apparatus.

Third Embodiment

Figure 14:
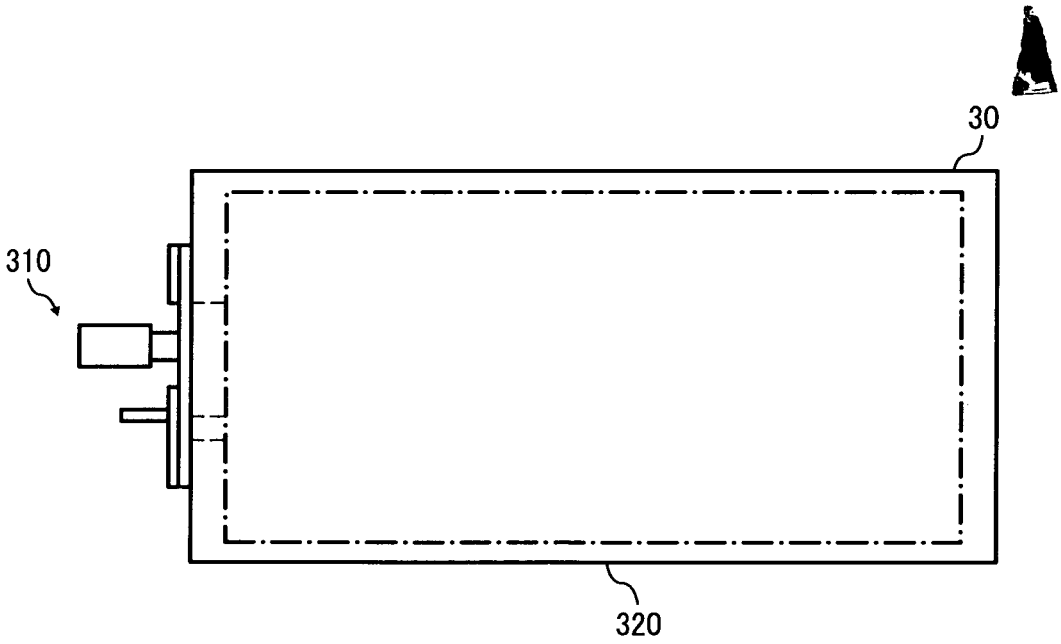
FIG. 14 shows an ink cartridge as the container according to another embodiment.

Further, as described above, the container can be adapted as an ink cartridge, shown in FIG. 14. In FIG. 14, reference numeral 30 represents an ink cartridge, 310 represents an connecting portion, 320 represents a cartridge body, serving as a container body, to contain the ink, (thin rectangular shape), the carriage body 310 can be adapted as a ink cartridge or ink baggage can be adapted. The shape of the container body of the consumables is not limited to the configuration as shown, 14, another shapes can be adapted.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an apparatus body including an image forming unit to form an image on a recording medium;

an openable top cover that includes a discharge tray and covers a first portion of a top surface of the apparatus body;

a fixed top cover adjacent the openable top cover that covers a second portion of the top surface;

a container-installation section in which at least one replaceable container is removably installable, positioned in the apparatus body, the container comprising:

a container body to contain consumables, having a transparent portion that makes the color of the consumables contained in the container body visible from outside thereof; and a connecting portion, covered by the fixed top cover and connectible to the container-installation section of the apparatus body, to supply the consumables from the container to the apparatus body;

a first holder provided in the container-installation section of apparatus body to hold the connecting portion of the container in a state in which the container is installed in the apparatus body and cover the connecting portion so that the connecting portion is not visible when the top cover is opened; and a second holder, provided in the container-installation section of the apparatus body, to hold the container body of the container in the state in which the container is installed in the apparatus body, such that the color of the consumables in the container body are visible through the transparent portion of the container body when the openable top cover is opened, wherein the entire container body is covered by the openable top cover when the container is fully installed in the apparatus body.

2. The image forming apparatus according to claim 1, wherein the first holder, the second holder, and the openable top cover are provided on an upper portion of the apparatus body.

3. The image forming apparatus according to claim 1, wherein the fixed top cover covers the first holder that holds the connecting portion of the container.

4. The image forming apparatus according to claim 3, wherein a portion of a top surface of the apparatus overlying the container-installation section in which the container is disposed is covered with the openable top cover and the fixed top cover.

5. The image forming apparatus according to claim 1, further comprising additional multiple containers to store mutually different colors of consumables.

6. The image forming apparatus according to claim 1, further comprising a rotary shaft around which the openable top cover is rotated when the openable top cover is opened and closed, a longitudinal direction of the rotary shaft parallel to a longitudinal direction of the container.

7. The image forming apparatus according to claim 1, wherein, when the openable top cover is opened, a space is created above the container body of the container and next to a posterior of the container body in a direction in which the container is installed in the apparatus body.

8. The image forming apparatus according to claim 1, wherein the image forming apparatus comprises a tandem-type multicolor image forming apparatus.

9. The image forming apparatus according to claim 1, wherein the image forming apparatus comprises a single-color image forming apparatus.

10. The image forming apparatus according to claim 1, wherein the consumables comprise toner.

11. The image forming apparatus according to claim 1, wherein the consumables comprise ink.

12. The image forming apparatus according to claim 1, wherein the connecting portion of the container is a cap.

13. An image forming apparatus comprising:

an apparatus body including an image forming unit to form image onto a recording medium;

a container-installation section in which at least one replaceable container removably installable in the apparatus body;

the container comprising:

a container body to contain consumables such that the color of consumables contained in the container body is visible from outside thereof; and a connecting portion to be installed in the apparatus body, an openable top cover, that includes a discharge tray, to cover substantially the entire container body of the container disposed in the apparatus body, and dimensioned so that substantially the entire container body of the container is exposed and the color of the consumables in the container body are visible when the top cover is opened;

a fixed top cover to cover a vicinity of the connecting portion of the container so that the connecting portion of the container is not visible from the outside when the openable top cover is opened.

14. The image forming apparatus according to claim 13, wherein a portion of a top surface of the apparatus overlying the container-installation section in which the container is disposed is covered with the openable top cover and the fixed top cover.

15. The image forming apparatus according to claim 14, wherein the connecting portion is located on one side of the container and the connecting portion of the container is surrounded by the fixed top cover.

16. The image forming apparatus according to claim 13, further comprising additional multiple containers to store mutually different color consumables.

17. The image forming apparatus according to claim 13, wherein the image forming apparatus comprises a tandem-type multicolor image forming apparatus.

18. The image forming apparatus according to claim 13, wherein the image forming apparatus comprises a single color image forming apparatus.

19. The image forming apparatus according to claim 13, wherein the consumables comprise toner.

20. The image forming apparatus according to claim 13, wherein the consumables comprise ink.

* * * * *